US008668153B2

(12) United States Patent
Johnson

(10) Patent No.: US 8,668,153 B2
(45) **Date of Patent: *Mar. 11, 2014**

(54) SPRAY NOZZLE FOR LOW CLEARANCE SPRAYING

(75) Inventor: Thomas Les Johnson, Moundsview, MN (US)

(73) Assignee: UDOR U.S.A. Inc., Lino Lakes, MN (US)

( * ) Notice: Subject to any disclaimer, the term of this patent is extended or adjusted under 35 U.S.C. 154(b) by 669 days.

This patent is subject to a terminal disclaimer.

(21) Appl. No.: 12/849,386

(22) Filed: Aug. 3, 2010

(65) Prior Publication Data

US 2010/0294851 A1 Nov. 25, 2010

Related U.S. Application Data

(63) Continuation-in-part of application No. 12/361,898, filed on Jan. 29, 2009, now Pat. No. 7,780,093.

(51) Int. Cl.
*B05B 17/00* (2006.01)

(52) U.S. Cl.
USPC ..... 239/1; 239/504; 239/505; 239/509; 239/512; 239/514; 239/522; 239/523; 239/595

(58) Field of Classification Search
USPC ..... 239/522, 523, 512, 509, 505, 595, 1, 239/504, 514
See application file for complete search history.

(56) References Cited

U.S. PATENT DOCUMENTS

| | | | | |
|---|---|---|---|---|
| 1,639,162 | A | 8/1927 | Brooks | |
| 1,805,782 | A | 5/1931 | Munz | |
| 2,338,273 | A | 1/1944 | Wilkins | |
| 2,539,061 | A | 1/1951 | Coles | |
| 2,785,005 | A | 3/1957 | Thompson | |
| RE24,353 | E * | 9/1957 | Kromer | 239/505 |
| 2,864,652 | A * | 12/1958 | O'Brien et al. | 239/523 |
| 3,085,754 | A | 4/1963 | Thompson | |
| 3,468,484 | A * | 9/1969 | Hunter | 239/204 |
| 4,168,033 | A | 9/1979 | Von Bernuth et al. | |
| 4,461,426 | A | 7/1984 | Christopher | |
| 4,624,414 | A | 11/1986 | Ferrazza | |
| 4,828,182 | A | 5/1989 | Haruch | |
| 5,076,497 | A | 12/1991 | Rabitsch | |
| D325,428 | S | 4/1992 | Vitsur | |
| 5,240,184 | A | 8/1993 | Lawson | |
| 5,620,142 | A | 4/1997 | Elkas | |
| 7,108,204 | B2 * | 9/2006 | Johnson | 239/522 |
| 7,487,924 | B2 * | 2/2009 | Johnson | 239/1 |
| 7,780,093 | B2 * | 8/2010 | Johnson | 239/1 |
| 7,806,350 | B2 * | 10/2010 | Langiewicz et al. | 239/600 |
| 8,328,112 | B2 * | 12/2012 | Johnson | 239/1 |

OTHER PUBLICATIONS

Catalog—W.L. Hamilton & Co., Marshall, Michigan, 1986, pp. 17, 18 and 23.
Catalog—Kuker Industries, Inc., Omaha, Nebraska, 1994, pp. 54 and 57.

* cited by examiner

*Primary Examiner* — Dinh Q Nguyen
(74) *Attorney, Agent, or Firm* — Altera Law Group, LLC

(57) ABSTRACT

A spray nozzle includes an orifice disposed on a substantially planar discharge surface. An impingement surface is disposed opposite the orifice, the impingement surface forming an angle with a centerline of the orifice. A deflection ridge bridges a gap between the impingement surface and the discharge surface. Adjacent the deflection ridge is a further trough which extends into the impingement surface. The nozzle includes a fluid fitting adapted for providing a pressurized fluid to the orifice.

18 Claims, 8 Drawing Sheets

SPRAY NOZZLE FOR LOW CLEARANCE SPRAYING

CROSS REFERENCE

This application is a Continuation in Part of patent application Ser. No. 12/361,898 filed 29 Jan. 2009 now U.S. Pat. No. 7,780,093.

FIELD OF THE INVENTION

The invention relates generally to spray nozzles, and more particularly to nozzles evenly dispersing fluid in a generally planar sector. An improved nozzle according to the present invention can more evenly distribute a fluid over the area covered by nozzle's spray pattern than previous designs yet have a low ground clearance.

BACKGROUND OF THE INVENTION

Spray nozzles used for dispersing fluids are well known. In agricultural applications, nozzles that can evenly disperse a liquid agent (fertilizer, insecticide, water, etc) are especially useful. The accuracy and consistency of nozzle spray patterns are important in modern systems due to advances in the agricultural sciences. For example, satellite surveys of fields can be used to direct GPS located vehicles for the accurate dispersion of agents on a crop, the dispersion pattern based on an analysis of the satellite survey. Given the precise distribution required by such a system, a nozzle that can accurately and consistently deliver an agent over a given area is highly desirable.

Flow through nozzles is typically quite turbulent. In the case of a liquid being discharged into the atmosphere, two-phase fluid interface conditions also exist. As a result, accurate modeling of nozzle performance by analytical means is highly complex, and may not feasible. Therefore, optimization of nozzle performance generally requires testing various geometries by trial and error. In such testing, seemingly innocuous changes to geometry can make a significant difference in nozzle performance.

There is a need for a spray nozzle with superior dispersion characteristics. Especially desirable is a nozzle that can evenly distribute a fluid over the nozzle's spray area. The present invention fulfills these and other needs, and provides several advantages over prior spray nozzle systems.

Furthermore, in addition to being able to disburse fluid evenly along a wide swath, it is highly desirable to do this without using a boom or an arm which extended outwardly and had a plurality of nozzles spaced along the boom. Such "boomless" sprayers are advantageous because they allow the user (usually on a vehicle like a small truck or ATV, to spray far from the operator and not be bound by the interference of an extending boom.

In my U.S. Pat. Nos. 7,108,204 and 7,487,924, I invented a highly effective solution to this boomless challenge. In such this boomless spray configuration, the typical boom height was 2 or 5 feet (0.5-2 meters) from the nozzle to the ground. In certain configurations it is critical to get as low as 12 inches (30 cm) to the ground yet the sideway "throw" of the nozzle. Such low clearance boomless spaying has heretofore been impossible without losing lateral range (3-5 meters) or maintaining an even flow across the entire length of the throw. The present invention addresses these problems.

SUMMARY OF THE INVENTION

To overcome the limitations in the prior art described above, and to overcome other limitations that will become apparent upon reading and understanding the present specification, the present invention discloses a spray nozzle design.

In one embodiment, a spray nozzle includes a discharge surface and an orifice disposed on the discharge surface. An impingement surface oppositely faces the orifice. The impingement surface is oriented at an impingement angle measured relative to a centerline of the orifice, the impingement angle being 90 degrees or less. The spray nozzle further includes a deflection ridge. The deflection ridge bridges a gap between the impingement surface and the discharge surface and defines a spray angle which limits the discharge of fluid. A fluid fitting is in fluid connection to the orifice. The fluid fitting is adapted to receive a pressurized fluid.

In one configuration, the impingement angle is generally 85 degrees. The deflection ridge may include a filleted corner, and the filleted corner can be formed to smoothly join with the impingement surface. Alternatively, the deflection ridge includes two filleted corners, the filleted corners intersecting at an angle defining a spray angle. The two filleted corners can be made to smoothly join with the impingement surface. The spray angle defined by the corners is about 100 degrees to about 160 degrees.

In another configuration, the deflection ridge includes a filleted corner and a sharp corner, the filleted corner and the sharp corner intersecting at an angle defining a spray angle. The spray angle is about 80 degrees to about 120 degrees. The interface between the filleted corner and the impingement surface may include a sharp ridge. The filleted corner can be made to extend past the intersection of the filleted corner and the sharp corner and forming a spherical indentation therein. The sharp corner may include a trailing edge curve extending towards the filleted corner at a distal end of the sharp corner. The sharp corner may also include a leading edge curve extending away from the filleted corner at the intersection of the filleted corner and the sharp corner.

In another embodiment of the present invention, a spray nozzle system includes a body having a discharge surface, an orifice disposed on the discharge surface, and a fluid fitting in fluid connection to the orifice. The fluid fitting adapted to receive a pressurized fluid. A spray head is mountable to the body. The spray head includes an impingement surface, the impingement surface oppositely facing the discharge surface. The impingement surface is oriented at an impingement angle measured relative to a centerline of the orifice, the impingement angle being 90 degrees or less. A deflection ridge bridges a gap between the impingement surface and the discharge surface, the deflection ridge defining a spray angle which limits the discharge of fluid. The spray head can be configured to be removable from the body and/or interchangeable on the body.

In another embodiment of the present invention, a method of dispersing fluid involves discharging a pressurized fluid from an orifice on a discharge surface. The fluid is deflected at an impingement surface to form an impingement flow. The impingement surface is oriented at a deflection angle measured relative to a centerline of the orifice, the angle being less than 90 degrees. The impingement flow is deflected to limit an exit plume to a limited circumferential angle. Limiting the exit plume to a limited circumferential angle may further involve deflecting the impingement flow using a filleted corner, or using two filleted corners, the filleted corners intersecting at an angle defining a spray angle. In another aspect, limiting the exit plume to a limited circumferential angle further involves using a filleted corner and a sharp corner, the filleted corner and the sharp corner intersecting at an angle defining a spray angle. The fluid can be pressurized in a range from about 25 psi to about 35 psi.

In another embodiment of the invention, a spray nozzle includes a body having a substantially planar discharge surface. A fluid fitting is included on an end of the body away from the discharge surface. An orifice is disposed on the discharge surface and in fluid connection with the fluid fitting. A spray head is removably attached to the body. The spray head includes a substantially planar sealing surface interfaceable with the discharge surface of the body. The sealing surface has a generally triangular shape with a triangular base and a rounded triangular tip opposite the triangular base. A planar impingement surface is indented in the sealing surface. The impingement surface oppositely faces the orifice when the spray head is attached to the body. The impingement surface is oriented at an impingement angle measured relative to a centerline of the orifice, the impingement angle being 90 degrees or less. The spray head includes a deflection ridge at the intersection of the impingement surface and the sealing surface. The deflection ridge is at least in part adjacent to the triangular base of the sealing surface.

In a further embodiment there is disclosed a spray nozzle, having a discharge surface; an orifice disposed on the discharge surface; an impingement surface oppositely facing the orifice, the impingement surface oriented at an impingement angle measured relative to a centerline of the orifice, the impingement angle being 90 degrees or less; a deflection ridge, the deflection ridge bridging a gap between the impingement surface and the discharge surface the deflection ridge starting adjacent the discharge surfaces and terminating adjacent said impingement surface, a trough in said impingement surface and located adjacent the termination of said deflection ridge, a fluid fitting in fluid connection with the orifice, the fluid fitting adapted to receive a pressurized fluid.

Also disclosed is where impingement surface sits on a nozzle head portion, said head portion having a planar surface and where said trough extends into said impingement surface to generally the head portion planar surface.

Also disclosed is where the trough is hemispherical.

Also disclosed is where the trough is curved.

Also disclosed is where the nozzle further includes ridge interface transition between the deflection ridge and the trough includes a sharp intersection line.

Also disclosed is where the nozzle further includes a transition between the deflection ridge and the trough includes a curved intersection surface.

Also disclosed is where the trough extends into the impingement surface to the planar surface of the head portion.

Also disclosed is where the trough extends up to the impingement surface to the planar surface of the head portion.

Also disclosed is where the trough extends across substantially the length of the deflection ridge.

Also disclosed is where the trough extends across substantially the length of the impingement surface.

Also disclosed is a fluid spray nozzle, having a discharge surface; an orifice disposed on the discharge surface; an impingement surface oppositely facing the orifice, the impingement surface oriented at an impingement angle measured relative to a centerline of the orifice, the impingement angle being less than 90 degrees hereby a portion of fluid will be deflected back to along the discharge surface; a deflection ridge, the deflection ridge bridging a gap between the impingement surface and the discharge surface, a trough in said impingement surface and located adjacent said deflection ridge and running substantially along the length thereof; said orifice is laterally spaced apart from the deflection ridge and a fluid fitting in fluid connection with the orifice, the fluid fitting adapted to receive a pressurized fluid.

Also disclosed is where the deflection ridge, interface and trough are substantially co-extensive.

Also disclosed is where deflection ridge, interface and trough are substantially co-extensive are "v" shaped about a central intersection line.

Also disclosed is where deflection ridge, interface and trough are substantially co-extensive are "v" shaped about a central intersection line and wherein said "v" shape is inwardly pointing.

Also disclosed is where the trough has the shape of a radiused ball cut.

Also disclosed is a method of dispersing fluid, having the following steps in any order; discharging a pressurized fluid from an orifice onto an impingement surface, the impingement surface oriented at a deflection angle measured relative to a centerline of the orifice, the angle being less than 90 degrees; deflecting at least a portion of the fluid at the impingement surface to form an impingement flow; and deflecting at least a portion of the impingement flow at a deflection ridge to restrict an exit plume to a limited circumferential angle; deflecting at least a portion of the flow into a trough cut into the impingement surface.

Also disclosed is where the method has a deflection angle is generally 85 degrees.

Also disclosed is a method of locating the trough adjacent the deflection ridge.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
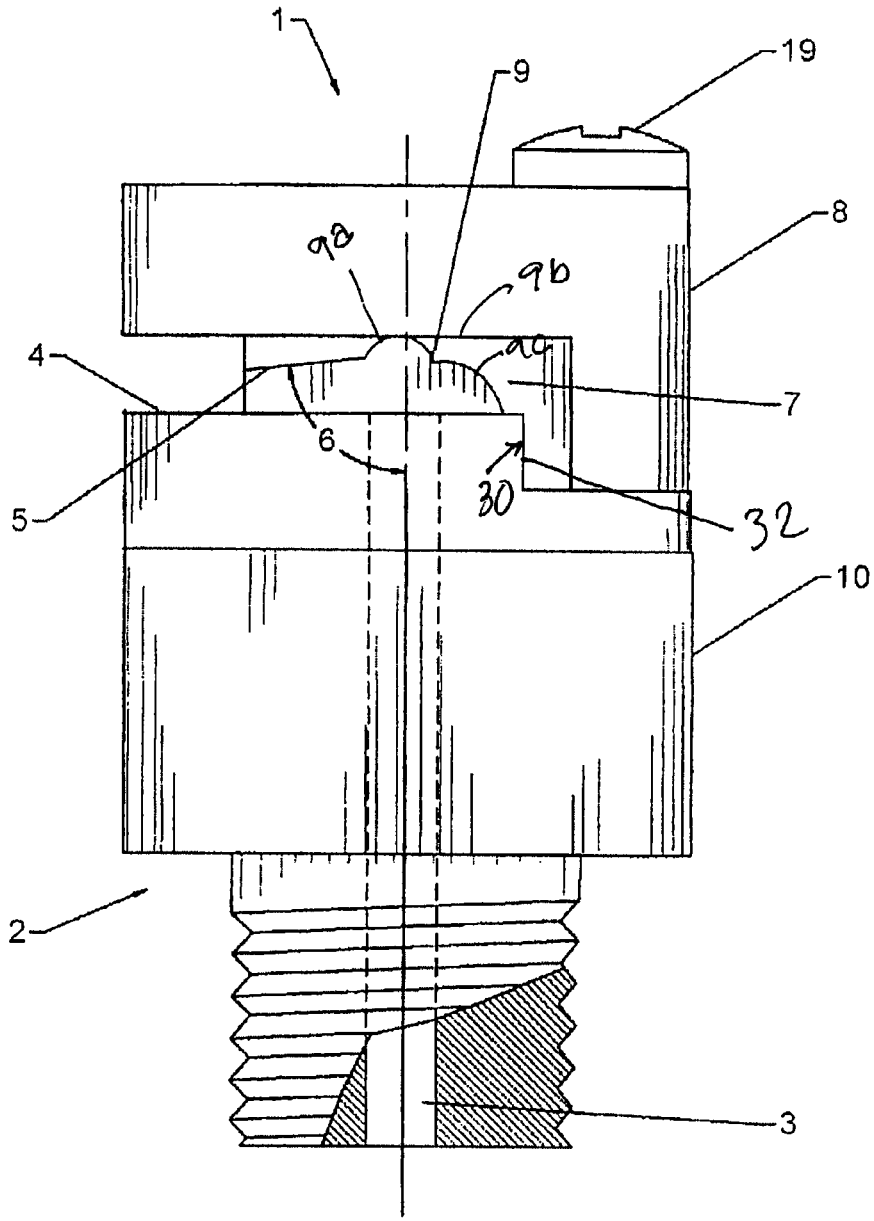
FIG. 1 is a side view of a nozzle according to the present invention.

While the invention is amenable to various modifications and alternative forms, specifics thereof have been shown by way of example in the drawings and will be described in detail herein. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF THE VARIOUS EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

The following patents are incorporated by reference: U.S. Pat. Nos. 7,108,204 and 7,487,924 and patent application Ser. No. 12/361,898.

Turning to FIG. 1, a side view of a nozzle, generally designated by reference numeral 1, is illustrated. The nozzle 1 includes a fluid fitting 2 which allows the nozzle 1 to be mounted to a fixture (e.g. a pipe or spray boom). The fluid fitting 2 also provides a fluid connection for the orifice 3. The orifice 3 allows fluid to pass from the fluid fitting 2 to where it exits at the discharge surface 4.

The discharge surface 4 is oriented substantially perpendicular to the orifice 3.

The discharge surface 4 as shown in FIG. 1 is substantially planar. Opposite the discharge surface 4 is the impingement surface 5. The impingement surface 5 is oriented at an angle 6 relative to the centerline of the orifice 3. Orienting the impingement surface 5 at an impingement angle 6 less than 90 degrees provides a restriction for fluid flowing between the discharge surface 4 and impingement surface 5. It is understood that a range of angles can be defined between an arbitrarily oriented line and surface (e.g. plane), and the impingement angle 6 is the smallest angle that can be formed between the orifice centerline and the impingement surface 5.

Fluid exiting the orifice 3 will impact the impingement surface 5. The impinging fluid forms an impingement flow upon striking the impingement surface 5. Impingement flow is an external flow (e.g. stream or jet) that is redirected due to impacting a surface at an impingement point. The impingement flow appears as a thin sheet of fluid that spreads out in all directions across the impinged surface from the impingement point. Part of the impingement flow in the nozzle 1 is forced directly out the gap between the impingement surface 5 and the discharge surface 4. Fluid is blocked in other directions by the deflection ridge 7. The deflection ridge 7 bridges the gap between the impingement surface 5 and the discharge surface 4, thereby limiting the flow to a partial circumferential angle (i.e. less that 360 degrees) around the nozzle 1. As shown in FIG. 1, the deflection ridge 7 can be formed at least in part by a fillet/ball cut/trough between the impingement surface 5 and the body of the spray head 8. It is preferably curved or hemispherical. The deflection ridge 7 in this embodiment interfaces with the impingement surface 5 at ridge interface 9 which may or may not have a sharp corner. From ridge interface 9 is a trough/cut/depression 9*a* which is cut into the impingement surface 5 preferably to the base/floor 9*b* of the head 8. The floor 9*b* is defined as the base surface from which the impingement surface 5 extends outwardly therefrom.

This trough or cut 9*a* is preferably a ball cut or hemispherical with the base thereof extending to the base 9*b*. Cut 9*a* extend substantially along the entire impingement surface as shown in various embodiments in FIG. 3-7. Notice that in the preferred embodiment cut 9*c* is roughly only a quarter turn (roughly 90 degrees whereas cut 9*a*, is nearly 180 degrees or a half turn.

I have found that this trough provides dramatically enhanced performance of the nozzle when placed in low clearance above the ground, typically 12 in to 3 ft (30 cm-1 meter). The invention is not limited to placement at these ground clearances, but has the unexpected result of still being able to provide a long even distribution throw out many feet/meters (for example 10 fit/3.5 m).

There are other configurations available besides this preferred configuration. For example, the ball cut/trough/depression 9*a*, may be "V" shaped or curved but not hemispherical, such as oval or as a hyperbola, radiused or other curvature. Ridge interface 9 may be sharp transition as shown or rolled off/gradual. Furthermore, the base of the cut 9*a* does not have to be limited to the floor 9*b*. It may be cut into the floor or may be elevated thereabove. The optimal cut for a particular need can be determined without undue experimentation.

So in this embodiment, there is a first cut 15, preferably hemispherical, a ridge interface 9, preferable sharp, and then a further cut 9*a* into the head, this cut having a cross section smaller than the cross section of cut 15.

The fluid plume exiting the nozzle is formed of two flow components. The first flow component is impingement flow that directly exits the nozzle 1. The second flow component includes impingement flow that hits the deflection ridge 7 and is thereby deflected out the nozzle 1. Since these two flow components have different paths, they will achieve different states (e.g. velocities) when exiting the nozzle 1. By careful design of geometric features (e.g size and shape of the impingement surface 5 and deflection ridge 7), these two flow components can be tuned such that the resultant flow has even dispersion characteristics over an area covered by the nozzle plume.

Figure 2:
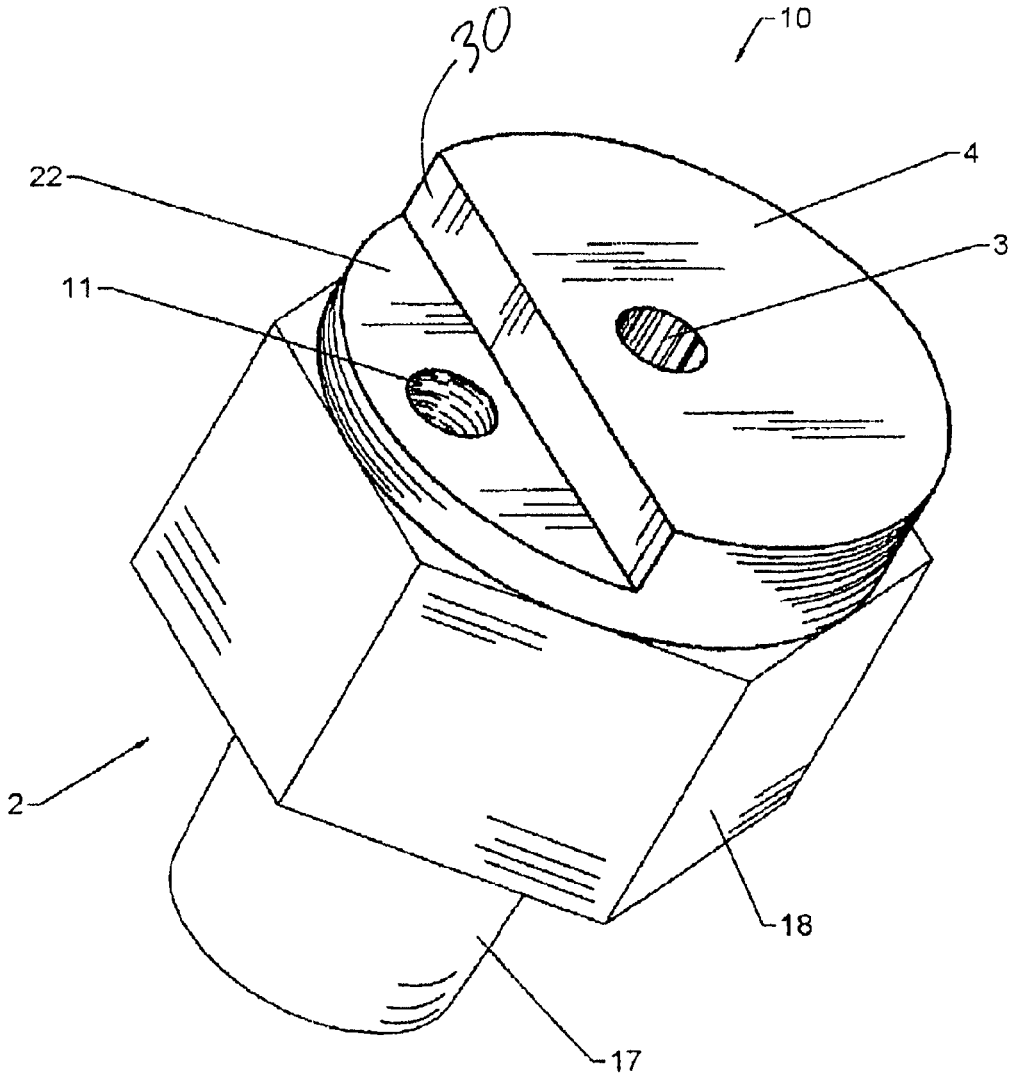
FIG. 2 is a perspective view of a nozzle body according to the present invention.

In one embodiment, the nozzle 1 is made of two pieces, a spray head 8 and a nozzle body 10. FIG. 2 illustrates one configuration of a nozzle body 10. The nozzle body 10 includes an orifice 3 and a discharge surface 4. The nozzle body 10 also includes a fluid fitting 2. The fluid fitting 2 may include a threaded shaft 17 and a hexagonal perimeter 18 suitable for tightening with a standard wrench. Other configurations of a fluid fitting 2 can be used that are well known in the art. For example, members that can serve as a fluid fitting 2 include a flange, a pneumatic-style quick disconnect, or a weldment. The body can be made of metals or plastics. The body may include a step 30 which mates with its counterpart step 32 in the head. This step provides a reliable interface between the parts and prevents rotation or misalignment, but other means to do this are possible, such as alignment pins.

Figure 3:
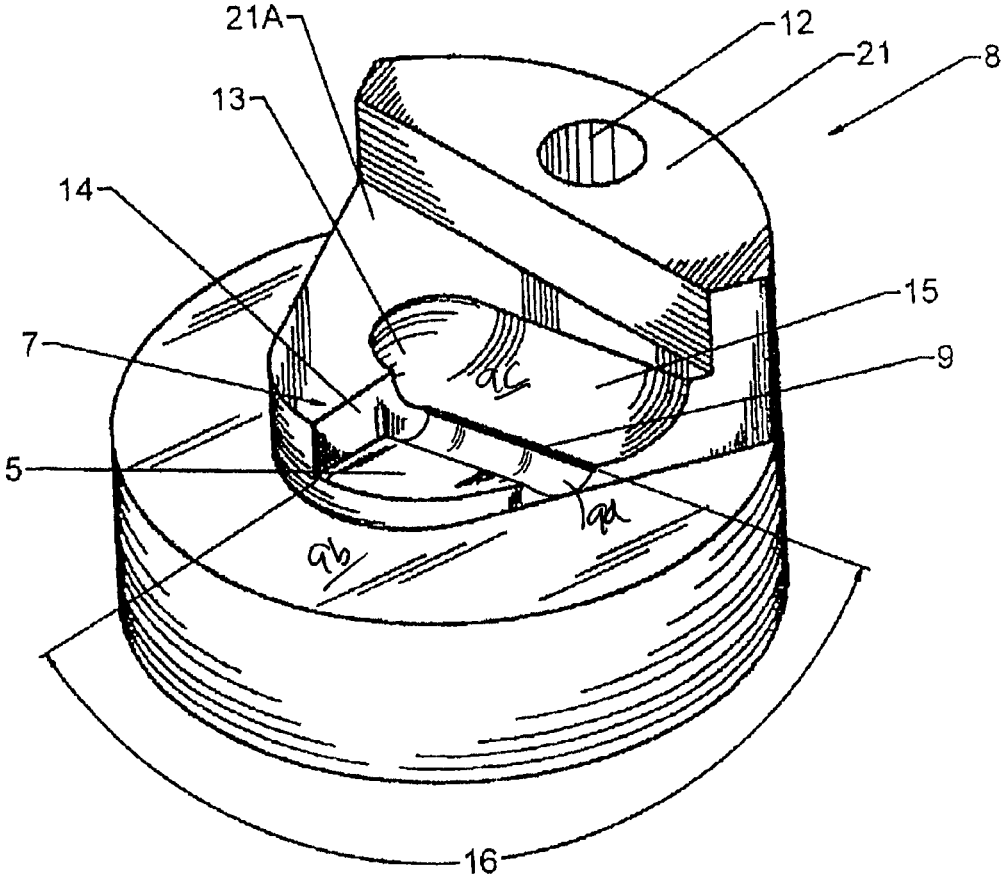
FIG. 3 is a perspective view of an embodiment of a spray head according to the present invention.

The body 10 also includes a mounting hole 11 and mounting surface 22 that can be used to interface with a spray head 8. One embodiment of a spray head 8 is shown in FIG. 3. The spray head 8 includes a mounting hole 12 and mounting surface 21 that lines up with the mounting hole 11 and mounting surface 22 on the body 10. The mounting holes 11, 12 are aligned so that the spray head 8 and body 10 can be assembled using a fastener such as a screw 19 (best seen in FIG. 1).

Referring again to FIG. 3, the spray head 8 includes a sealing surface 21A that interfaces with the body's discharge surface 4 when the spray head 8 and body 10 are mated together. The sealing surface 21A is generally triangular in shape (which includes the inverted triangle shown in FIG. 8, with a base of the triangle located adjacent the mounting surface and the tip 9*f* (which also includes the inverse tip 9*f* in FIG. 8). opposite the base oriented towards the nozzle's direction of discharge. The tip of the triangular shaped sealing surface 21A has a rounded profile. The impingement surface 5 is formed as a planar indentation/step in the sealing surface 21A. The interface between the impingement surface 5 and the sealing surface 21A defines the deflection ridge 7. At least part of the deflection ridge 7 is adjacent to the triangular base of the sealing surface 21A, thereby deflecting fluid generally towards the rounded triangular tip of the sealing surface 21A.

Figure 4:
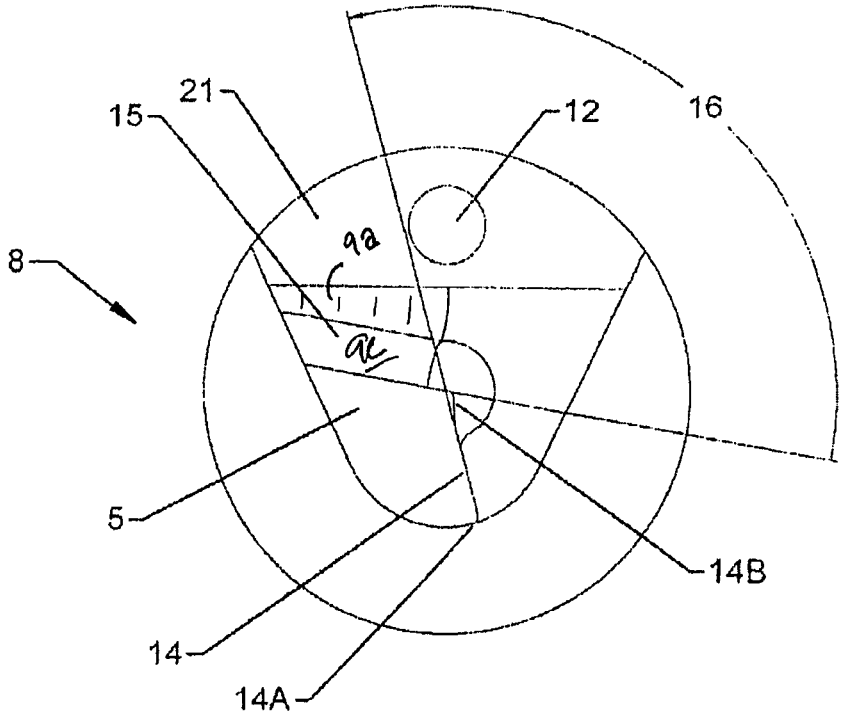
FIG. 4 is a plan view of an alternate embodiment of a spray head according to the present invention.

In the embodiment illustrated in FIG. 3, the deflection ridge 7 is formed by the intersection of two features, a sharp corner 14 and a filleted corner 15. The sharp corner 14 and the filleted corner 15 intersect at an spray angle 16. The spray angle 16 influences the shape of the discharged fluid plume. The filleted corner 15 extends past the intersection of the filleted corner 15 with the sharp corner 14, such that a spherical indentation 13 is formed at the intersection. The spherical indentation 13 is located approximately near the impingement point of the flow leaving the orifice 3. As shown in FIG. 3, a further cut/trough/depression 9*a* does not have the same spherical indentation 13, but is an option which could be added so that both 9*a* and 9*c* terminate in a spherical end similar to 13. The filleted corner 15 joins with the impingement surface 5 at a sharp ridge interface 9. The sharp ridge interface 9 can be formed as a substantially 90 degree corner line along the length of the filleted corner 15. Alternatively, the sharp ridge interface 9 may be formed by a wedge shaped ridge such that there is a smooth interface where the filleted corner 15 joins the impingement surface 5 near the spherical indentation 13, thereafter forming an increasingly deeper corner line as the sharp ridges extends towards the trailing edge of the filleted corner 15. The spray head 8 embodiment illustrated in FIG. 3 has been found especially useful for spray angles 16 ranging from about 80 degrees to about 120 degrees. It is appreciated that a mirror image arrangement of features shown in FIG. 3 would allow a similar spray pattern to be formed in a direction opposite of that shown in FIG. 3. The further cut/trough 9*a* extends from ridge interface 9 into the body of the head, and then rises up to the remainder of the impingement surface 5. Turning now to FIG. 4, a spray head 8 similar to the embodiment shown in FIG. 3 is illustrated with additional features for improving spray dispersion characteristics. The spray head 8 includes a trailing edge curve 14A and a leading edge curve 14B located on the sharp corner 14. The trailing edge curve 14A is located at a distal (outward) end of the sharp corner 14, and extends inwards towards the filleted corner 15. The leading edge curve 14B is located near the intersection of the sharp corner 14 and the filleted corner 15, and extends away from the filleted corner 15. The vertical surface of the sharp corner 14 remains substantially perpendicular to the sealing surface 21A at both the trailing and leading edge curves 14A, 14B. It has been found that inclusion of trailing and leading edge curves 14A, 14B provides more even dispersion of fluid in nozzles with a spray angle of less that 140 degrees.

Figure 6:
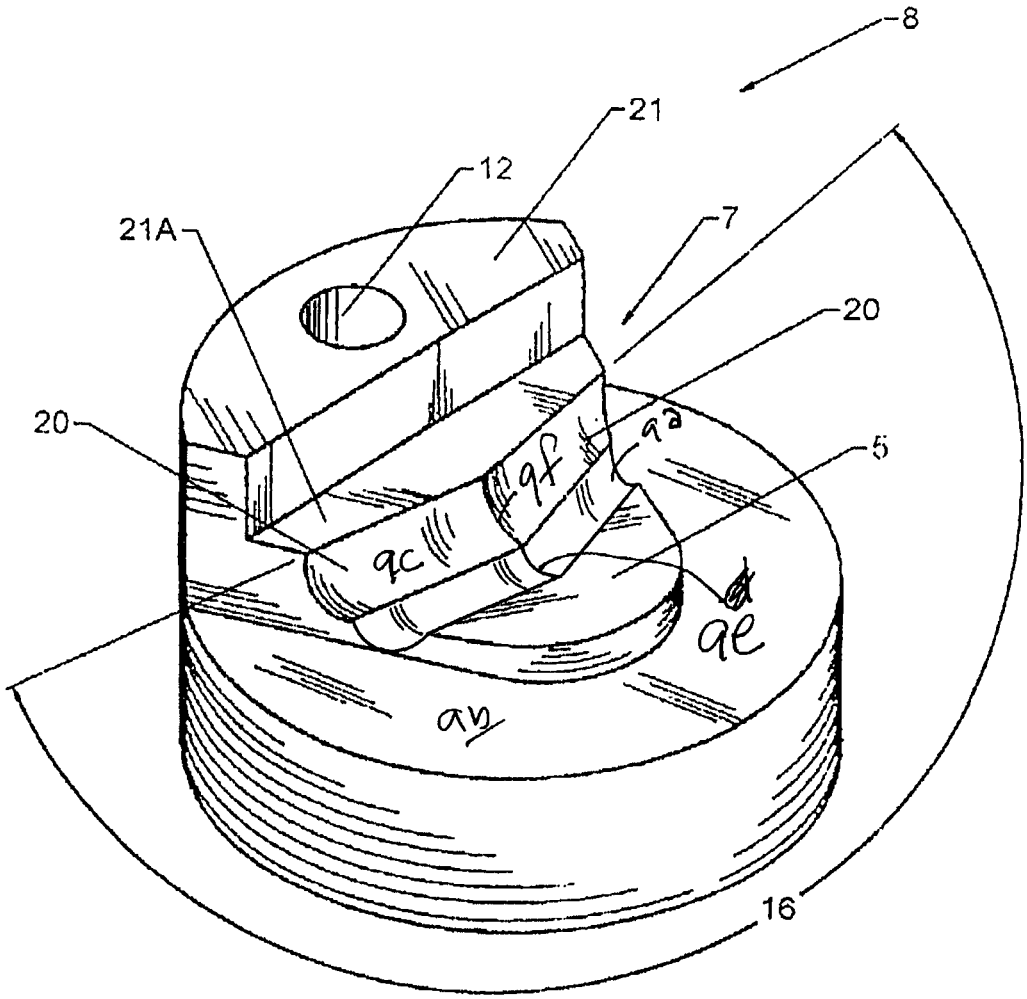
FIG. 6 is a perspective view of another embodiment of a spray head according to the present invention.
Figure 8:
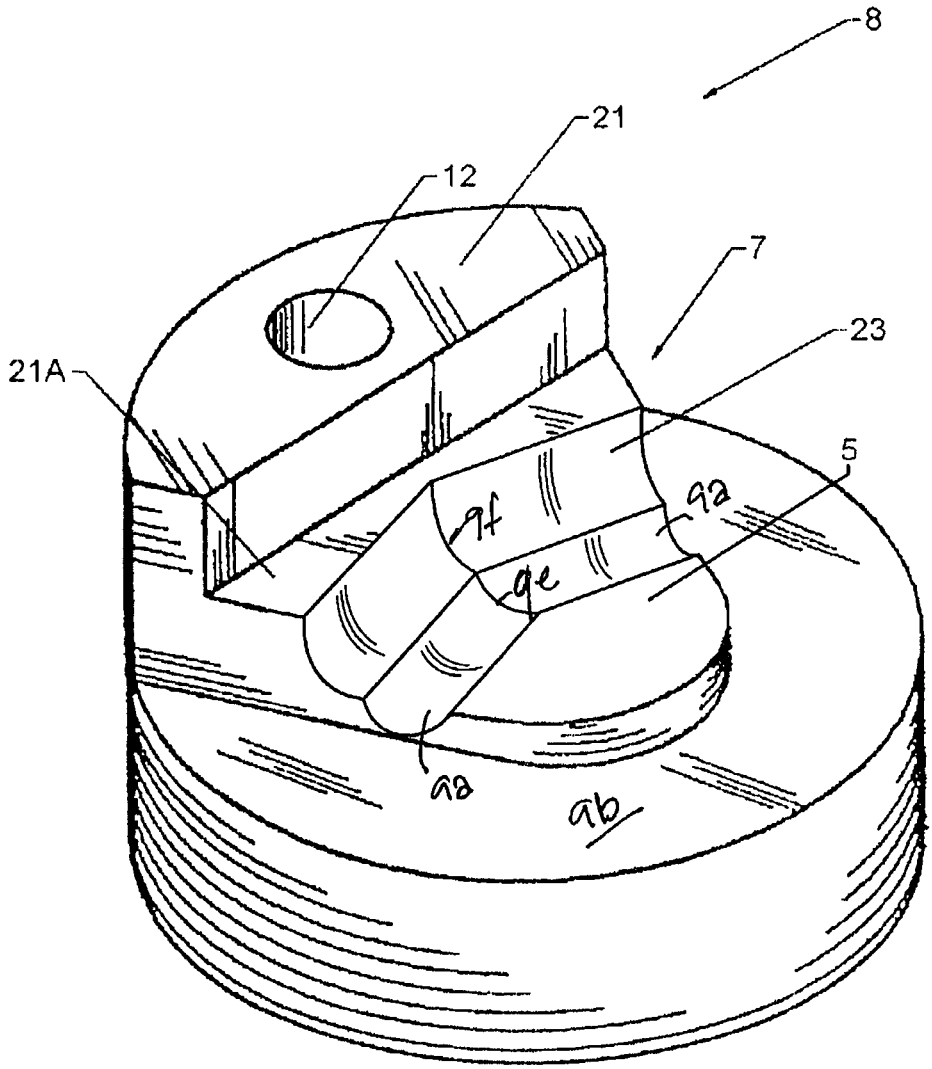
FIG. 8 a view like FIG. 6 except that the deflection ridge is an inverted V shape when compared to FIG. 6.

Another embodiment of a spray head 8 is shown in FIGS. 6 and 8 which differ in that FIG. 6 has a V shape with the center apex protruding outwardly (called convex for simplicity) whereas FIG. 8 has a central apex extending inwardly, or inwardly pointing, (called concave for simplicity). In this embodiment, the deflection ridge 7 is formed by two filleted corners 20. The filleted corners 20 intersect at a spray angle 16 along line 9*f*. In this embodiment, the filleted corners 20 smoothly join with the impingement surface 5. This configuration is especially useful in spray angles 16 ranging from about 180 degrees to about 220 degrees. Link in the previous embodiments, portion 9*c* is adjacent recess 9*a* and join at line 9*e*.

Figure 7:
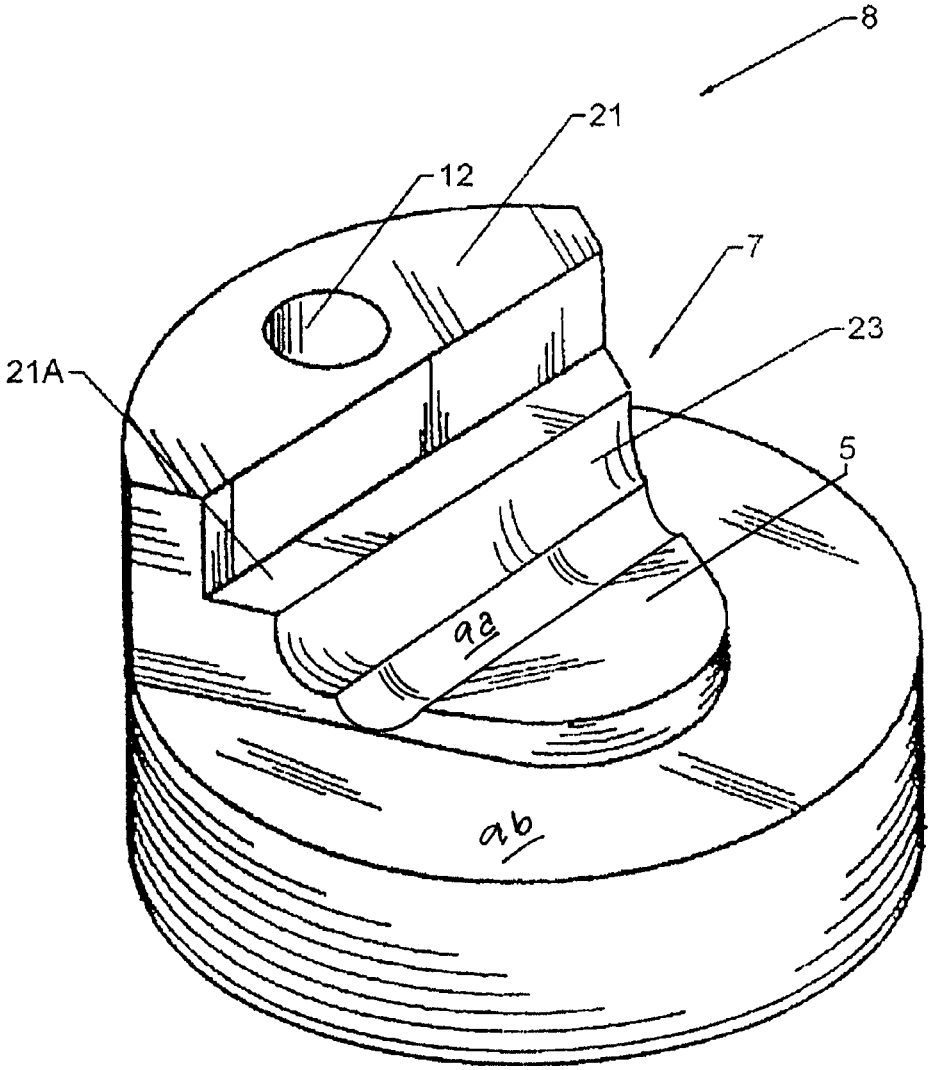
FIG. 7 is a perspective view of yet another embodiment of a spray head according to the present invention.

Yet another embodiment of a spray head 8 is shown in FIG. 7. In this embodiment, the deflection ridge 7 is formed by one filleted corner 23. The filleted corner 23 smoothly joins with the impingement surface 5. This configuration provides an approximately 180 degree spray pattern.

The spray heads 8 illustrated in FIGS. 3-7 include mounting holes 12 and interface surfaces 21 that are identically configured. This allows spray heads 8 of various geometries to be interchangeable on the body 10. Interchangeability of the spray head 8 allows for easy reconfiguration of a spray patterns on a system using a nozzle 1 according to the present invention. An interchangeable spray head 8 also allows for easy replacement of worn or damaged spray heads 8.

Figure 5:
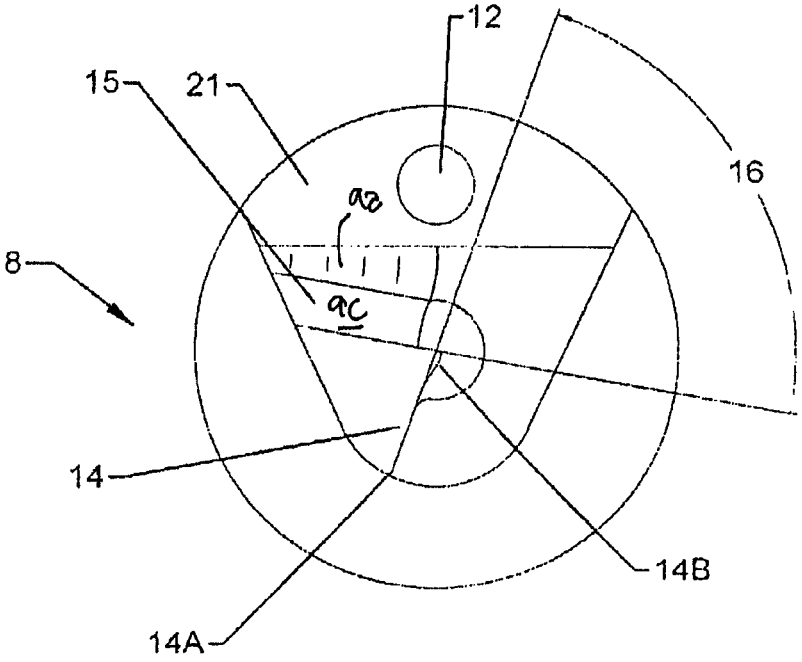
FIG. 5 is a plan view of an another embodiment of a spray head according to the present invention.
Figure 9:
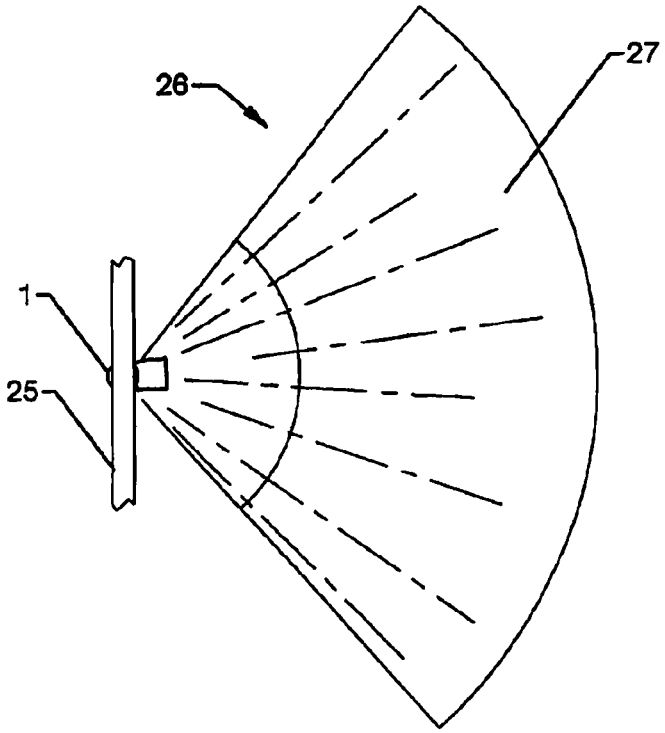
FIG. 9 is a top view showing a nozzle plume from a nozzle according to the present invention.
Figure 10:
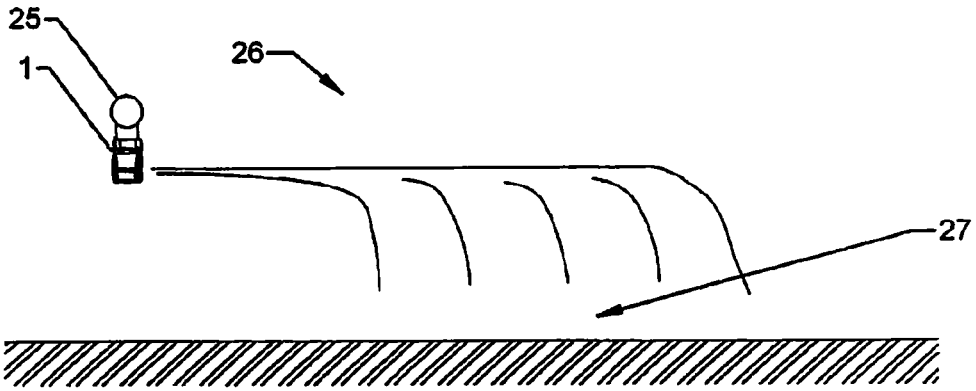
FIG. 10 is a side view of the nozzle plume from FIG. 9.

A nozzle 1 according to the present invention can be fabricated from a number of suitable materials. For discharge of liquids in an agricultural application, the nozzle 1 can be formed from a corrosion resistant steel such as 303 stainless steel. Other materials such as brass, carbon steel, aluminum, polymers and ceramics may be appropriate for the spray head 8 and/or the body 10 depending on the fluid to be discharged and the desired wear characteristics of the nozzle 1. Referring now to FIG. 8, a top view is shown of spray system with a nozzle 1 mounted upside down and vertically to a manifold 25. A plume 26 exits from the nozzle 1. The coverage area 27 is a sector shape with an angle determined by the nozzle's spray angle 16. In FIG. 9, a side view of the plume 26 shows the shape of the plume as it leaves the nozzle 1 and travels to the ground. A nozzle according to the present invention can provide a very even dispersion of fluid over the coverage area 27. This characteristic of even dispersion over a given area is highly advantageous when precise amounts of fluid are to be distributed. A configuration of a nozzle 1 according to the present invention is described hereinbelow that is particularly suited for discharging aqueous liquids into the atmosphere at a relative fluid pressure in a range of about 25 psi to about 35 psi. Such a configuration uses an orifice diameter of about 0.125 inches and a deflection angle 6 of about 85 degrees (±2 degrees). In such an application, a spray head 8 configured according to FIG. 3 includes a filleted corner 15 created using a 0.187 inch diameter ball end-mill cutting about 0.087 inches deep as measured from the sealing surface 21A. The spray head 8 in this example further includes a sharp ridge interface 9 with height of about 0.013 inches, the sharp ridge interface 9 being located at the interface between the filleted corner 15 and the impingement surface 5. The spray angle 16 is about 100 degrees. With the nozzle elevated about 36 inches from the ground, such an arrangement provides a spray pattern with even coverage to about 17 feet from the nozzle. The spray head 8 illustrated in FIG. 4 has a geometry similar to that of FIG. 3, except that the spray angle 16 is about 115 degrees. This embodiment also includes a trailing edge curve 14A with diameter of about 0.063 inches. A leading edge curve 14B about 0.060 inches long and extends away from the apparent intersection of the sharp corner 14 and the filleted corner 15 by a maximum distance of about 0.011 inches. The spray head 8 shown in FIG. 5 is similarly configured, except the spray angle 16 is about 80 degrees.

In another similar application (i.e. 25-35 psi fluid pressure, 0.125 orifice diameter, and 85 degree deflection angle), a spray head configured according to FIG. 6 can provide an even distribution of fluid out to 22 feet from a nozzle elevated at about 40 inches from the ground. In this configuration, the filleted corners 20 are formed with a 0.187 diameter ball end-mill, the fillets smoothly interfacing with the impingement surface 5. The spray angle 16 in this configuration is about 200 degrees. Notice that FIGS. 6 and 7 have two part section 9*a* and 9*c* which come to a point of intersection 9*e* and 9*f*. These are shown as sharp intersecting lines but may also be a curvature.

Also disclosed herein is a method of constructing a nozzle according to this disclosure having a discharge surface, an orifice in the discharge surface, and an impingement surface comprising: a.) providing an orifice for conducting a pressurized fluid onto an impingement surface, b.) locating the impingement surface at a deflection angle measured relative to a centerline of the orifice, the angle being 90 degrees or less; c.) deflecting the fluid along a deflection ridge bridging a gap between the impingement surface and the discharge surface; d.) forming a trough in the impingement surface adjacent the deflection ridge d. locating the orifice orthogonally relative to the discharge surface; and e.) limiting the cross sectional extent of the impingement surface so that its extent is less than the extent of the discharge surface; so that fluid exiting the orifice will generally strike the impingement surface and subsequently flow along the discharge surface before being discharged from the nozzle.

Also disclosed herein, is a method of dispersing fluid, having the following steps in any order; discharging a pressurized fluid from an orifice onto an impingement surface, the impingement surface oriented at a deflection angle measured relative to a centerline of the orifice, the angle being less than 90 degrees; deflecting at least a portion of the fluid at the impingement surface to form an impingement flow; and deflecting at least a portion of the impingement flow at a deflection ridge to restrict an exit plume to a limited circumferential angle; deflecting at least a portion of the flow into a trough cut into the impingement surface.

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth below and equivalents thereof.

The invention claimed is:

1. A spray nozzle, comprising:

a discharge surface;

an orifice disposed on the discharge surface said orifice defining an axis and discharge surface being planar and orthogonal to axis;

an impingement surface oppositely facing the orifice, the impingement surface oriented at an impingement angle measured relative to a centerline of the orifice, the impingement angle being 90 degrees or less;

a deflection ridge, the deflection ridge bridging a gap between the impingement surface and the discharge surface and being flush with said impingement surface, the deflection ridge starting adjacent the discharge surfaces and terminating adjacent said impingement surface;

a trough in said impingement surface and located adjacent the termination of said deflection ridge said trough being a hemispherical recess in said impingement surface thereby creating a discontinuity in the impingement surface from a generally planar portion to a tough portion and then a defecting ridge;

a fluid fitting in fluid connection with the orifice, the fluid fitting adapted to receive a pressurized fluid.

2. The spray nozzle of claim 1, wherein said impingement surface sits on a nozzle head portion floor, said head portion floor having a planar surface and where said trough extends into said impingement surface to generally to a depth reaching the head portion planar surface.

3. The spray nozzle of claim 1, wherein the trough is hemispherical.

4. The spray nozzle of claim 3, wherein the trough is curved.

5. The spray nozzle of claim 1, further including a ridge interface transition between the deflection ridge and the trough includes a sharp intersection line thereby creating a discontinuity on the impingement surface.

6. The spray nozzle of claim 1, wherein said impingement surface sits on a nozzle head portion floor, said head portion floor having a planar surface and further including a plurality of stepped curved surfaces extending from said deflection ridge including a filleted corner as a first step and a trough as a second step toward said floor, an wherein said impingement surface extends generally away from said trough.

7. The spray nozzle of claim 6 wherein the trough extents generally to said floor.

8. The spray nozzle of claim 6 wherein said impingement surface extends generally orthogonally away from said trough.

9. The spray nozzle of claim 1, wherein the trough extends across substantially the length of the deflection ridge.

10. The spray nozzle of claim 1, wherein the trough extends across substantially the length of the impingement surface.

11. A fluid spray nozzle, comprising:

a discharge surface;

an orifice disposed on the discharge surface said orifice defining an axis and discharge surface being planar and orthogonal to axis;

an impingement surface oppositely facing the orifice, the impingement surface oriented at an impingement angle measured relative to a centerline of the orifice, the impingement angle being less than 90 degrees hereby a portion of fluid will be deflected back to along the discharge surface;

a deflection ridge, the deflection ridge bridging a gap between the impingement surface and the discharge surface and being flush with said impingement surface, a trough in said impingement surface and located adjacent said deflection ridge and running substantially along the length thereof thereby creating a discontinuity in the impingement surface from a generally planar portion to a tough portion and wherein said impingement surface extends generally orthogonally away from said trough, said trough being a hemispherical recess in said impingement surface, said orifice is laterally spaced apart from the deflection ridge and a fluid fitting in fluid connection with the orifice, the fluid fitting adapted to receive a pressurized fluid.

12. The spray nozzle of claim 11, wherein the deflection ridge, interface and trough are substantially co-extensive.

13. The spray nozzle of claim 11, wherein deflection ridge, interface and trough are substantially co-extensive are "v" shaped about a central intersection line.

14. The spray nozzle of claim 11, wherein deflection ridge, interface and trough are substantially co-extensive are "v" shaped about a central intersection line and wherein said v shape is inwardly pointing.

15. The nozzle of claim 11, wherein the trough has the shape of a radiused ball cut.

16. A method of dispersing fluid, comprising:

discharging a pressurized fluid from an orifice onto an impingement surface, the impingement surface oriented at a deflection angle measured relative to a centerline of the orifice, the angle being less than 90 degrees;

deflecting at least a portion of the fluid at the impingement surface to form an impingement flow; and deflecting at least a portion of the impingement flow at a deflection ridge to restrict an exit plume to a limited circumferential angle;

deflecting at least a portion of the flow into a hemispherical trough cut into the impingement surface said trough being located adjacent the deflecting ridge thereby forcing a portion of the fluid to enter the trough;

providing a fluid pathway generally orthogonally away from said trough, and providing a narrowing fluid exit path.

17. The method of claim 16, wherein the deflection angle is generally 85 degrees.

18. The method of claim 16 where said narrowing fluid exit path is narrowed by a sloping impingement surface.

* * * * *